US012606976B1

(12) United States Patent
Taylor

(10) Patent No.: US 12,606,976 B1
(45) **Date of Patent: *Apr. 21, 2026**

(54) DEVICE AND METHODS FOR RAISING FOOTINGS AND FOUNDATIONS

(71) Applicant: Airlift Concrete Experts LLC., Malvern, AR (US)

(72) Inventor: Mike Taylor, Malvern, AR (US)

( * ) Notice: Subject to any disclaimer, the term of this patent is extended or adjusted under 35 U.S.C. 154(b) by 204 days.

This patent is subject to a terminal disclaimer.

(21) Appl. No.: 18/112,193

(22) Filed: Feb. 21, 2023

Related U.S. Application Data

(63) Continuation-in-part of application No. 29/715,950, filed on Dec. 5, 2019, now Pat. No. Des. 1,023,297, (Continued)

(51) Int. Cl.
*E02D 35/00* (2006.01)

(52) U.S. Cl.
CPC ..... *E02D 35/005* (2013.01); *E02D 2250/003* (2013.01)

(58) Field of Classification Search
CPC ... E02D 3/12; E02D 35/005; E02D 2250/003; F16L 1/06
See application file for complete search history.

(56) References Cited

U.S. PATENT DOCUMENTS 2,627,169 A * 2/1953 Poulter ..... E02D 35/00 405/267

4,058,986 A * 11/1977 Granholm ..... G01F 11/24 406/67

(Continued)

*Primary Examiner* — Benjamin F Fiorello
(74) *Attorney, Agent, or Firm* — Joe D. Calhoun

(57) ABSTRACT

A device and methods for raising an underground footing or foundation beneath a structure such as a home, office building or roadway, using a means of pumping expandable fluid into substratum below the area to be raised. The device includes an elongated shaft comprising a trailing end and a leading end and may define a fluid pathway from the upstream trailing end to the downstream leading end. The trailing end is adapted to secure fluid communication between the fluid pathway and the means of pumping expandable fluid may include. The fluid pathway terminates in a downstream fluid pathway exit, in a section of the leading end having a reduced diameter smaller than a diameter of the leading end upstream from said fluid pathway exit. The leading end further comprises a tip region converging to a point facilitating pushing of the leading end deeper into the substratum. The enlarged diameter of the leading end upstream from the fluid pathway exit defines an obstacle to upstream travel of the expandable fluid outside the fluid pathway exit, thereby containing the expandable fluid in the area beneath the footing to be raised. Besides the initial pushing of the leading end of the shaft into the substratum, the method for raising the footing also includes initially injecting a relatively smaller amount of expandable fluid at the initial depth, allowing the fluid to expand and solidify, then pushing the shaft further into the substratum to a deeper depth for injection of additional expandable fluid beneath the initial treatment area. This facilitates the raising of the initial treatment area rather than just the area of current injecting.

7 Claims, 9 Drawing Sheets

Related U.S. Application Data which is a continuation-in-part of application No. 15/997,145, filed on Jun. 4, 2018, now Pat. No. 10,520,111.

(56) References Cited

U.S. PATENT DOCUMENTS

| | | | | |
|---|---|---|---|---|
| 4,514,112 | A * | 4/1985 | Sano | E02D 3/12 405/269 |
| 4,640,649 | A * | 2/1987 | Nakanishi | E02D 3/12 405/233 |
| 9,512,587 | B2 * | 12/2016 | Arima | E02D 3/12 |
| 10,520,111 | B2 * | 12/2019 | Taylor | F16L 55/18 |
| 10,961,682 | B1 * | 3/2021 | Williams | E02D 31/10 |
| 2016/0362901 | A1 * | 12/2016 | Tabatabai | E04G 23/0203 |
| 2018/0209113 | A1 * | 7/2018 | Birtele | E02D 35/005 |
| 2019/0186095 | A1 * | 6/2019 | Eddie | G01N 33/24 |
| 2019/0194897 | A1 * | 6/2019 | Birtele | E02D 37/00 |
| 2020/0299918 | A1 * | 9/2020 | Moody | E02D 3/12 |

* cited by examiner

DEVICE AND METHODS FOR RAISING FOOTINGS AND FOUNDATIONS

CROSS REFERENCE TO RELATED APPLICATIONS

This application is a continuation-in-part of, and claims the benefit of the filing date of, co-pending design patent application No. 29/715,950 filed 5 Dec. 2019, which is a continuation-in-part of, and claims the benefit of the filing date of utility patent application Ser. No. 15/997,145 filed 4 Jun. 2018 (which is now patent Ser. No. 10/520,111), all of which are incorporated herein by reference.

FEDERALLY SPONSORED RESEARCH AND DEVELOPMENT

Not applicable.

MICROFICHE APPENDIX

Not applicable.

BACKGROUND OF THE INVENTION

(1) Field of the Invention

The present invention relates to a device and methods for raising footings and foundations that have sunken, without excavation. More particularly, the invention disclosed herein relates to an improved device and method involving the use of expandable liquids, such as foam-producing liquids, to expand into cavities and less-dense areas of soil beneath a footing or foundation for the purpose of raising the footing or foundation until it is no longer sunken.

(2) Background of the Invention

Without conceding that any of the following references constitutes prior art, the following references may have some disclosure that is arguably material to the subject matter of this application, in some form or fashion.

U.S. Pat. No. 10,465,355 entitled Injection Tube Countersinking, issued to Barron et al., discloses methods (and apparatuses used in those methods) of countersinking injection tubing below the surface of a structure, such as pavement, so that such injection tubing (used for soil stabilization) will not extend above the surface of the structure even after movement of the soil. The injection tubing facilitates injection of expandable polyurethane foam into loose soil to densify the soil and effect soil stabilization.

U.S. patent Ser. No. 10/520,111 entitled System and Method of Straightening Underground Pipe was issued to Applicant on 31 Dec. 2019. Among other things, it discloses: (a) driving diagonally into the ground above and beside a downwardly bowed section of pipeline, an elongated shaft comprising an upstream trailing end and a downstream leading end and may define a fluid pathway from the trailing end to the leading end, said trailing end securing fluid communication between said fluid pathway and means of pumping expandable fluid, said fluid pathway terminating in at least one downstream fluid pathway exit at the leading end of said shaft driven to just beneath the pipeline bow; and (b) pumping expanding fluid through said pathway and out said exit until said fluid expansion raises the pipeline until its top contacts the securely positioned intermediate probe-rod.

Known in the field are foam producing liquids used to enhance soil support. For example, U.S. Pat. No. 4,567,708 issued to Haekkinen discloses a method of levelling sunken portions of earth-supported floors or slabs, wherein holes are made in the floor through which polyurethane foam is pumped between the floor and the underlying earth; expansion of the foam creates pressure, which raises the sunken part of the floor.

U.S. Pat. No. 6,634,831 issued to Canteri discloses a method for increasing the bearing capacity of foundation soils for built structures, consisting of drilling holes spaced from each other deep in the soil, and injecting into the holes a substance which expands as a consequence of a chemical reaction, with a potential increase in volume of at least five times the volume of the substance before expansion. The expansion of the substance injected into the soil produces compaction of the contiguous soil, reinforce the foundation of the structure.

U.S. Pat. No. 7,135,087 issued to Blackmore discloses an apparatus and method for eliminating ground water infiltration while stabilizing the ground and repairing underground pipe/conduit and connections. The steps are to first inject expandable structural foam in the space adjacent and outside the pipeline while blocking any infiltration of the foam into the interior of the pipe, conduit or connection. Concurrently or separately, the inside diameter of the pipe receives structural repair by an inflatable bladder pressing a repair patch against the interior needing repair.

U.S. Patent Application Publication No. 2007/0031,195 of Canteri discloses a method for increasing the strength of a soil for supporting excavation faces, which comprises at least one reinforcement step that consists in boring spaced reinforcement holes arranged substantially vertically or inclined with respect to a vertical direction in the soil to be strengthened; reinforcement elements are then inserted in the reinforcement holes and are locked within the soil by injecting in the reinforcement holes a synthetic locking substance (such as polyurethane) that expands by chemical reaction and bonds the reinforcement elements with the soil.

U.S. Pat. No. 10,465,355 issued to Barron et al. discloses methods (and apparatuses used in those methods) of countersinking injection tubing below the surface of a structure such as pavement, so that injection tubing will not extend above the surface of the structure even after movement of the soil. For example, Barron discloses constructing an injection tube in three segments: (1) a leading injection tube end to remain underground after providing an exit for expandable fluid injected into loose soil needing compacting; (2) an "extender" segment extending from the trailing end of the injection tube to above the ground; and (3) and "advancer" segment for coupling to a hammer drill to drive the leading injection tube end and extender into the ground to the desired depth for injecting expandable fluid.

None of the known prior art discloses Applicant's method for raising footings and foundations without substantial excavation. For example, none of the known prior art provides a method using a directional fluid injection exit to direct an introductory amount of expandable fluid to prevent backflow of subsequently injected expandable fluid above the initial fluid injection site. Nor does the known prior art provide an injection shaft that is re-usable after removal, in a manner allowing re-use of the injection shafts.

SUMMARY OF THE INVENTION

In general, the method and device described herein involves an apparatus for raising underground footings and foundations without substantial excavation, using an injection rod to inject expandable fluid(s) beneath the portion of foundation or footing needing raising (the "injection site"). The user essentially pushes the injection shaft down into the soil or other substratum beneath a sunken area of foundation or footing to be raised, but initially perhaps not to the deepest depth beneath the sunken area that the user anticipates or suspects might eventually be required. Typically the injection shaft is pushed into the ground at a slight diagonal angle, heading towards any central "sweet spot" beneath the most noticeable sunken area of the footing or foundation. The initial injection site may be at a shallower depth (en route to the suspected sweet spot), perhaps not directly beneath the most noticeable sunken area.

Preferably the injection shaft has a sturdy leading end with a pointed tip, and preferably has a diameter smaller than that of the shaft at the opposite trailing end used to push the shaft into the soil. The shaft defines a fluid pathway from the upstream trailing end to the downstream leading end, and the leading end also preferably includes a fluid pathway exit near the tip. Preferably the fluid pathway exit is on the side of the leading end rather that at the point; this enables the user to rotate the shaft axially while it is in the ground, to inject the expandable fluid in the direction(s) desired. The fluid pathway exit preferably has a means of shielding the exit from being clogged by soil or other debris when it is pushed into the ground. One preferred means is a portion of the shaft wall cantilevering over a leading portion of the exit. The injection shaft is re-usable.

Besides infilling cavities and other voids in the soil in the vicinity of the injection site, and compacting and otherwise stabilizing the soil in the vicinity of the injection site, the methods and device disclosed herein seal the upward escape pathway of the expandable fluid along the outer surface of the injection shaft. Moreover, the multi-level injections of this method also multiply the upward raising force by repetition of the process below the initial injection site and any related injection sites.

One primary benefit of the disclosed invention is to provide an injection rod, and methods of using it, that will enable the injection rod to be re-used.

Another primary benefit of the disclosed invention is to provide a manner of containing the expandable fluid injected below ground, so that the benefits of its expansion properties are multiplied.

Another primary benefit of the disclosed invention is to provide a multi-level injection method that multiplies the raising force and other benefits of the expandable fluid using only one injection rod.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other methods, devices, features and advantages herein provided will become apparent to one with skill in the art upon examination of the accompanying Figures and detailed description. It is intended that all such additional methods, devices, features and advantages that are included within this description, be within the scope of any claims filed now or later.

BRIEF DESCRIPTION OF THE DRAWINGS

The novel features believed characteristic of the disclosed subject matter will be set forth in any claims that are filed. The disclosed subject matter itself, however, as well as a preferred mode of use, further objectives, and advantages thereof, will best be understood by reference to the following detailed description of an illustrative embodiment when read in conjunction with the accompanying drawings.

Figure 1:
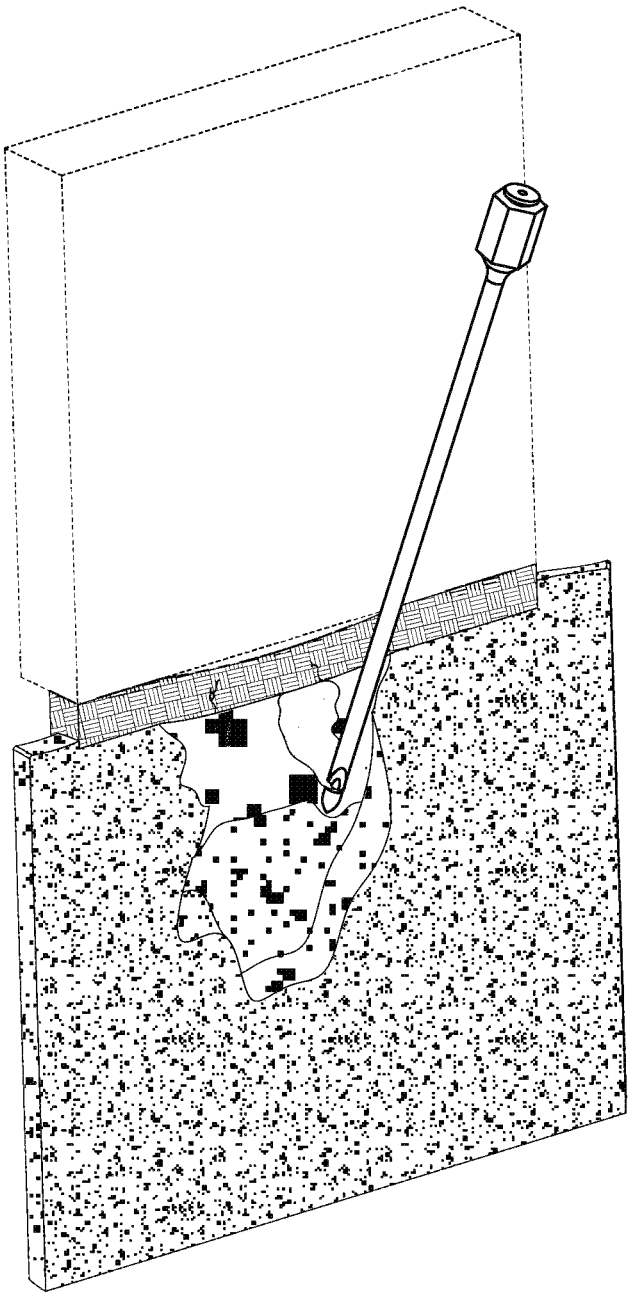
FIG. 1 depicts a representative sectional view showing a sunken area of a patio slab atop soil, with a representative sample of an injection rod pushed diagonally into position for injection of expandable foam beneath the sunken area to raise it; also shown is expanded foam in the injection site and partially up the rod's pathway through the soil.
Figure 2:
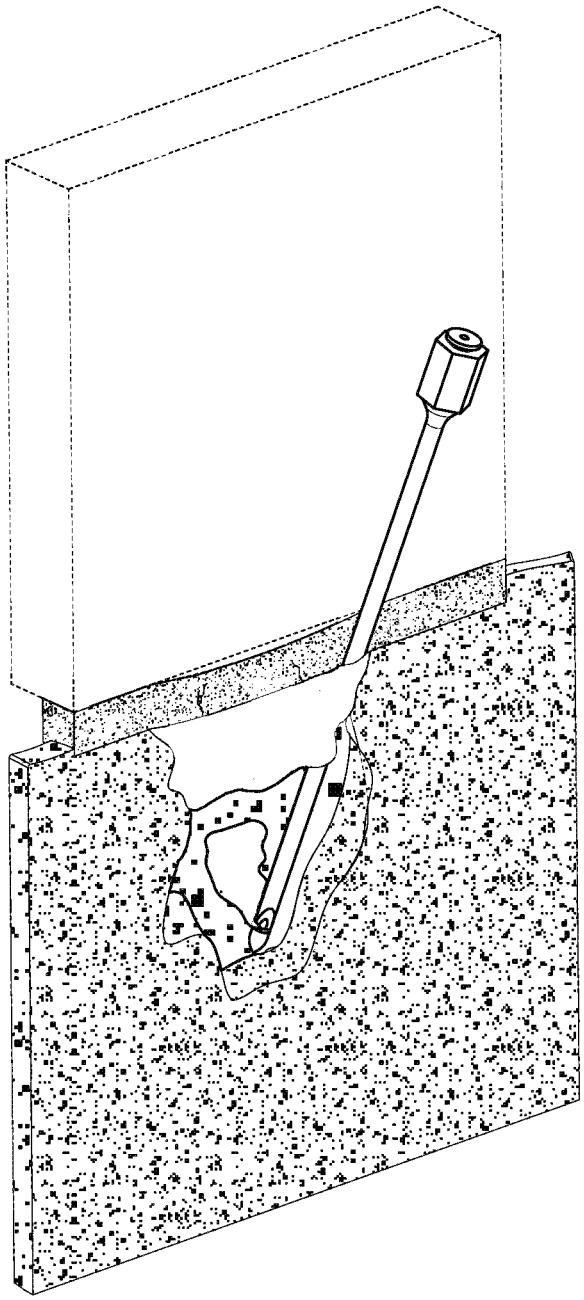
FIG. 2 depicts the same sectional view as FIG. 1, with the injection rod pushed through the injection site and positioned deeper beneath the sunken area to be raised; also shown is expanded foam in the deeper injection site.
Figure 3:
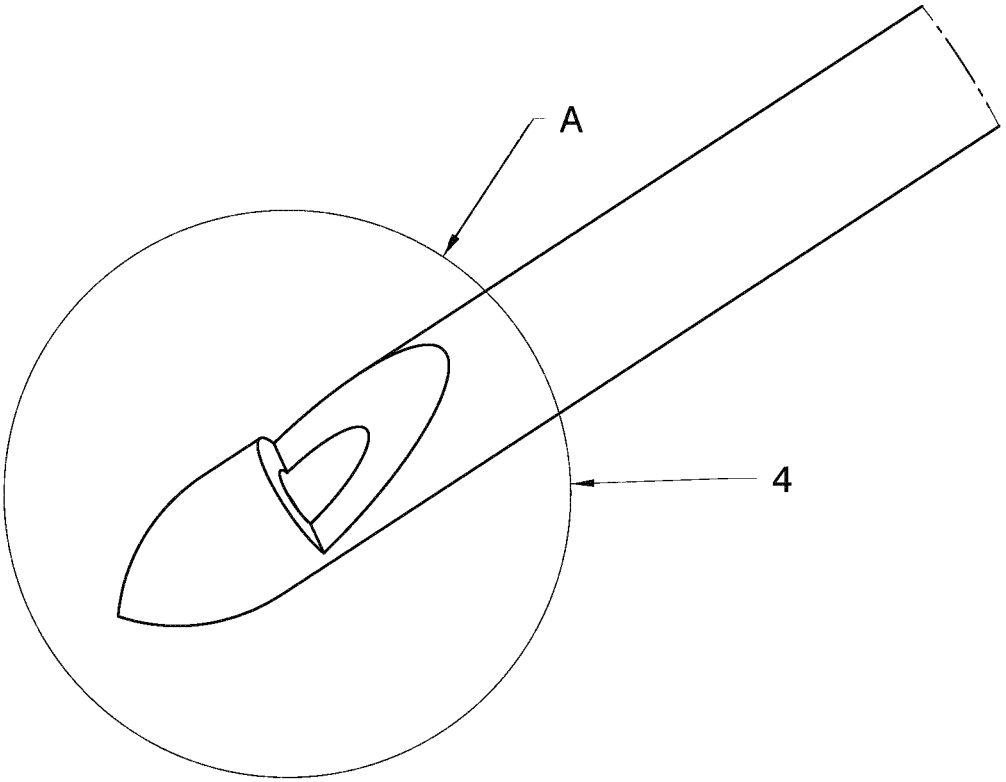
FIG. 3 depicts a perspective view of the leading end of a representative example of the injection rod, in isolation.
Figure 4:
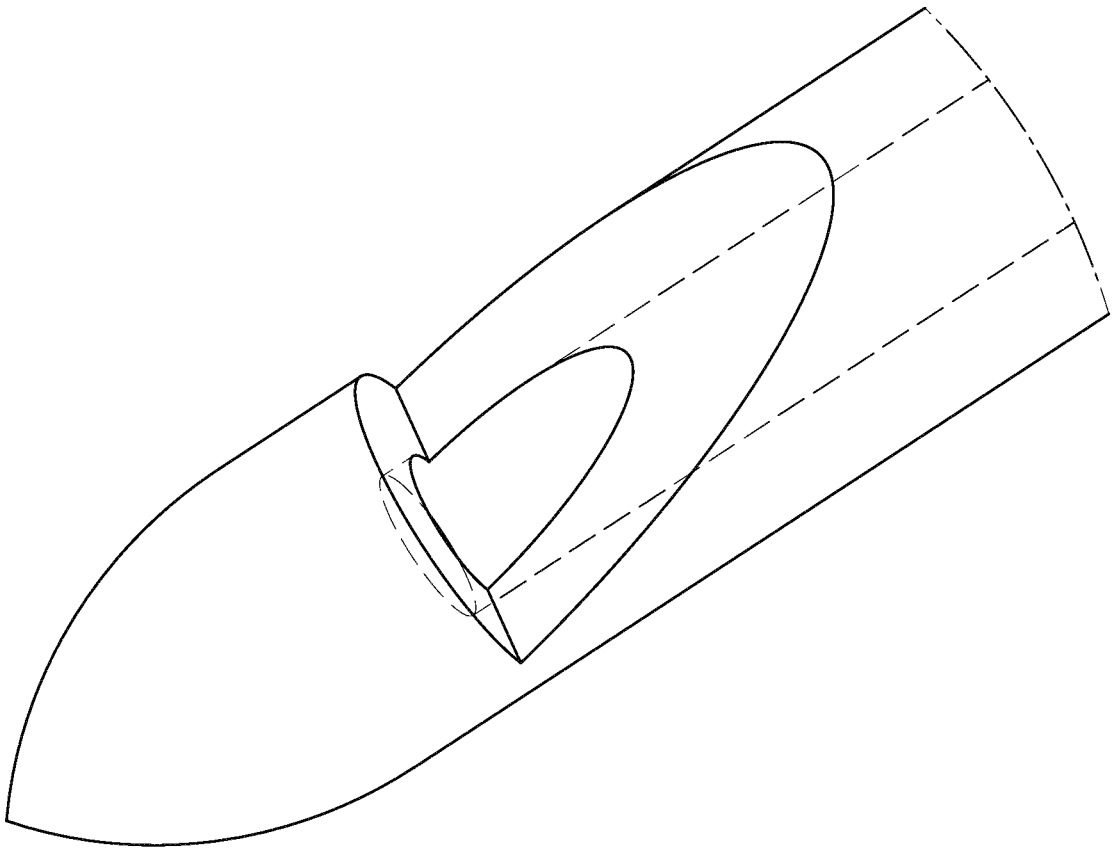
FIG. 4 depicts a closeup of the subject matter encircled in FIG. 3.
Figure 5:
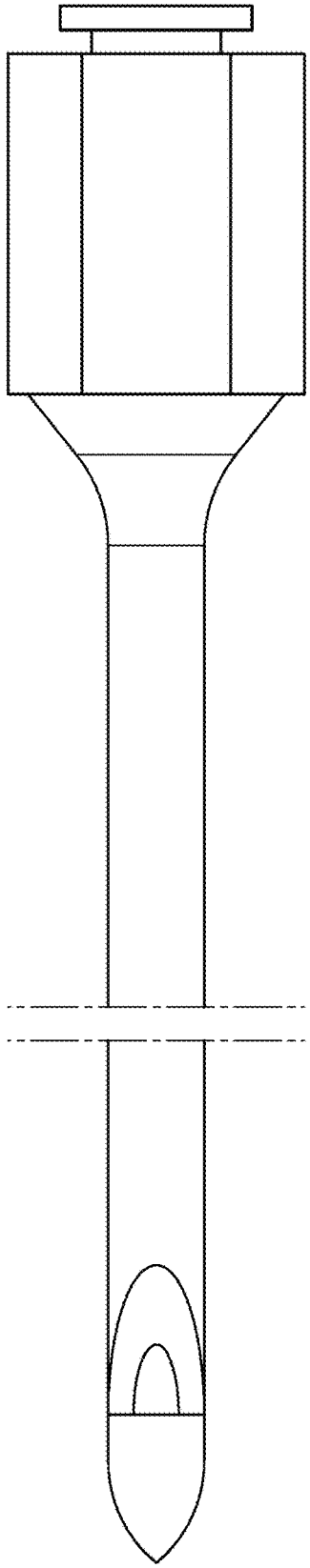
FIG. 5 depicts a side elevation thereof after being rotated 90 degrees.
Figure 6:
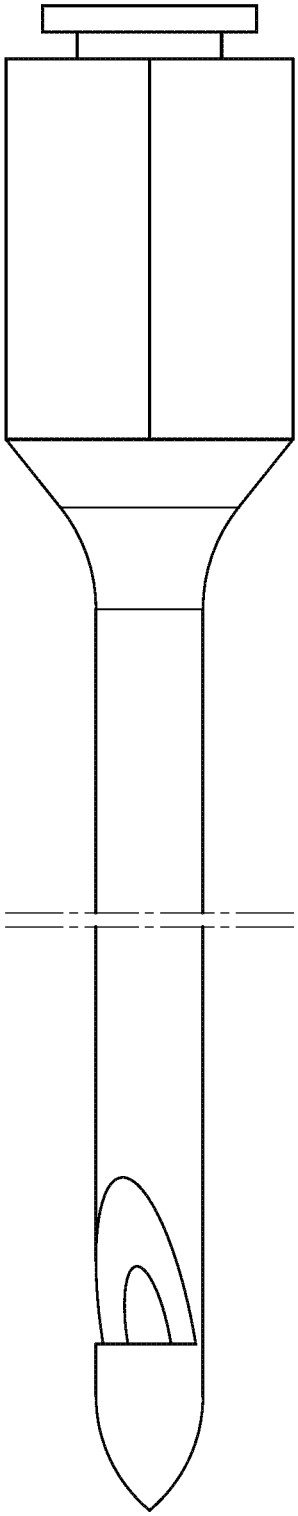
FIG. 6 depicts a side elevation view thereof after being rotated an additional 90 degrees.
Figure 7:
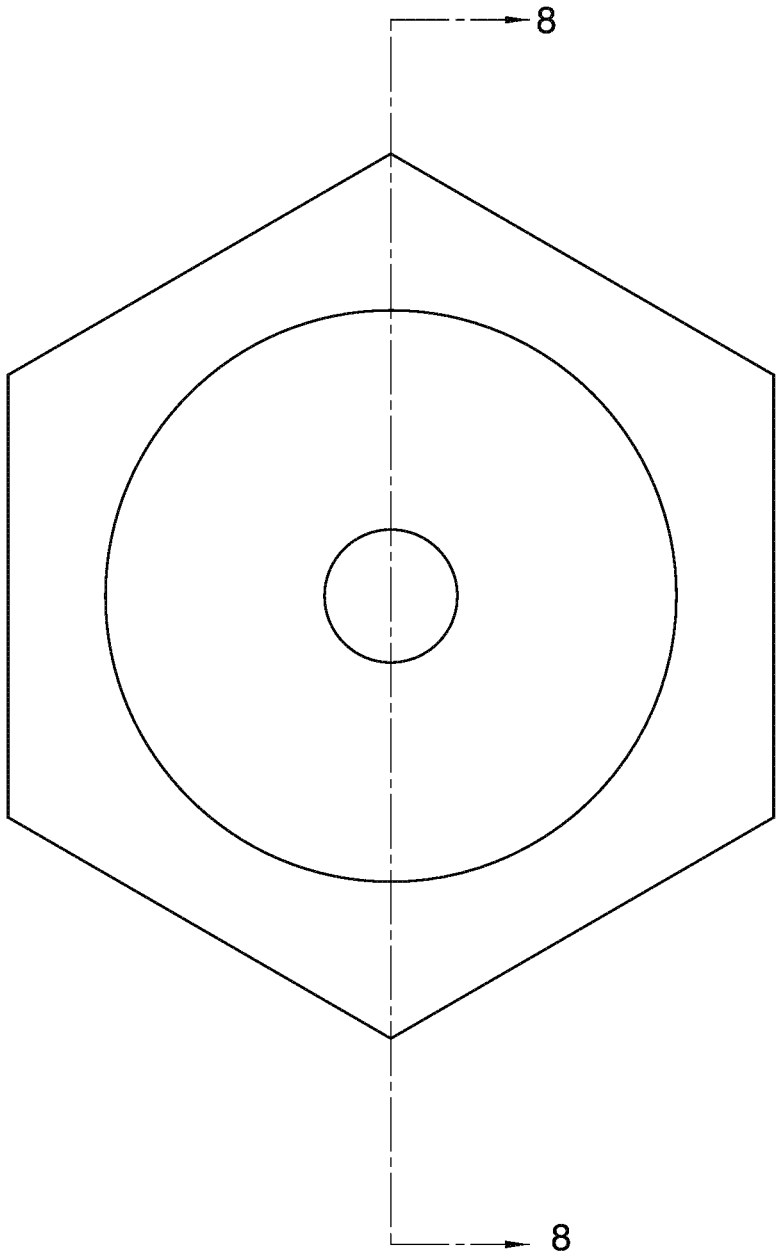
FIG. 7 depicts a closeup elevation view of the trailing end of the injection rod.
Figure 8:
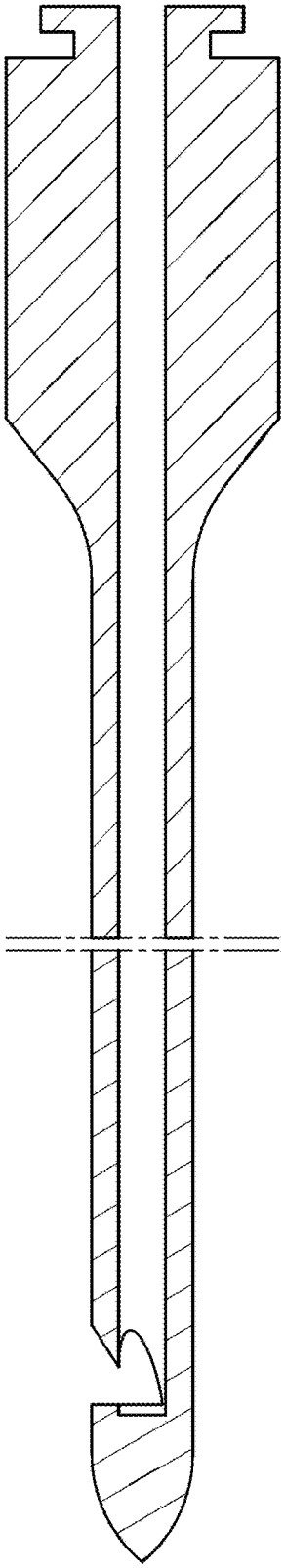
FIG. 8 depicts a longitudinal cross-section view of the injection rod, along the plane 8-8 of FIG. 7.
Figure 9:
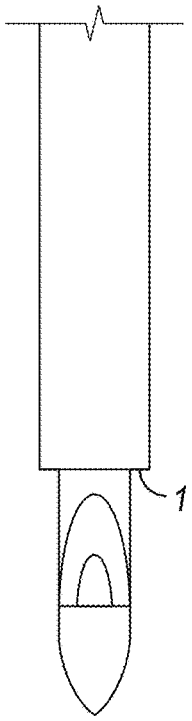
FIG. 9 depicts a side elevation view of another representative example of an injection rod, showing an immediate transition (1) from a smaller diameter portion to a larger diameter portion.
Figure 10:
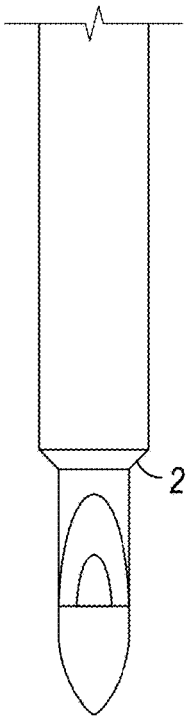
FIG. 10 depicts a side elevation view of another representative example of an injection rod, showing a gradual transition (2) from a smaller diameter portion to a larger diameter portion.
Figure 12:
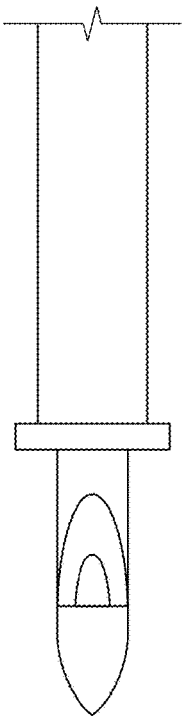
FIG. 12 depicts a side elevation view of another representative example of an injection rod, showing an immediate transition from a larger diameter portion upstream from the fluid exit to a smaller diameter portion.
Figure 13:
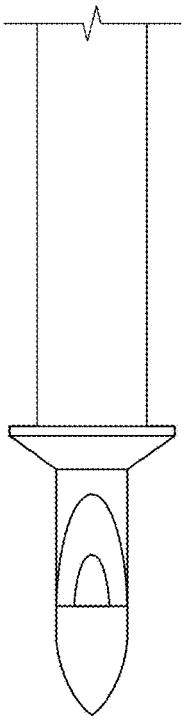
FIG. 13 depicts a side elevation view of another representative example of an injection rod, showing a gradual transition from a larger diameter portion upstream from the fluid exit to a smaller diameter portion.
Figure 11:
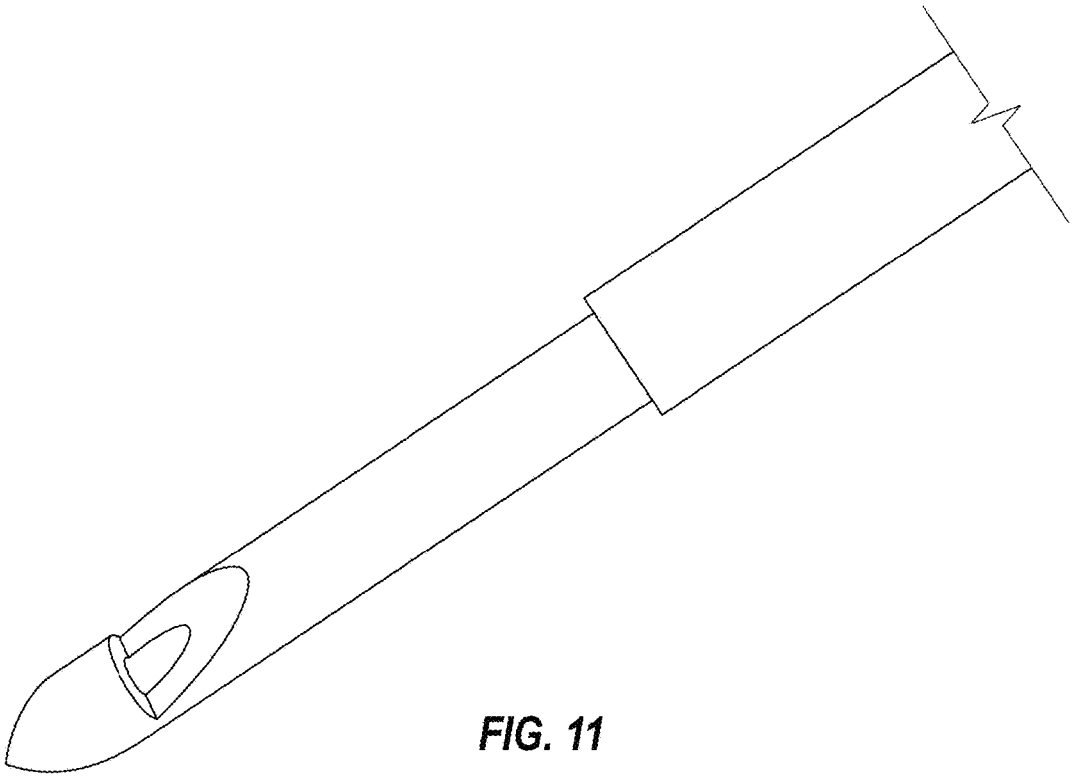
FIG. 11 depicts a perspective view of another representative example of an injection rod, showing an immediate transition from a larger diameter portion upstream from the fluid exit to a smaller diameter portion.

These drawings illustrate certain details of certain embodiments. However, the invention disclosed herein is not limited to only the embodiments so illustrated. The invention disclosed herein may have equally effective or legally equivalent embodiments.

DETAILED DESCRIPTION OF THE INVENTION

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising", or "includes" and/or "including", or "have" or "having", when used in this specification, specify the presence of stated features, regions, integers, steps, operations, elements and/or components, but do not preclude the presence or addition of one or more other features, regions, integers, steps, operations, elements, components and/or groups thereof.

For the sake of simplicity and to give the claims of this patent application the broadest interpretation and construction possible, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

It will be understood that, although the terms first, second, third, etc. may be used herein to describe various elements, these elements should not be limited by these terms. These terms are only used to distinguish one element from another element. Likewise, synonyms for the same element, term or concept may be used only to distinguish one similar element from another, unless the context clearly indicates otherwise.

The disclosure herein is not limited by construction materials to the extent that other materials satisfy the structural and/or functional requirements. For example, any material may be used so long as it satisfies the rigid structural and functional needs. In one embodiment, the device is constructed of steel material; however, any material of sufficient rigidity and durability will suffice as well. Likewise, the disclosed invention is not limited by any construction process or method.

In most general terms, the invention disclosed herein comprises (includes) a device for raising an underground footing or foundation using a means of pumping expandable fluid for injection into the soil and/or other substratum ("soil") below the area of the footing or foundation to be raised. The expandable fluid is known in the field. Examples include structural polyurethane (or geotechnical polyurethane foam) such as NCFI. The expandable fluid expands and solidifies into hard material during a post-injection curing duration. The device may include an elongated shaft including a trailing end and a leading end and may define a fluid pathway from the upstream trailing end to the downstream leading end, the trailing end adapted to secure fluid communication between the fluid pathway and the means of pumping expandable fluid, the fluid pathway terminating in a downstream fluid pathway exit on the lateral surface of a section of the leading end having a reduced diameter smaller than a diameter of the leading end upstream from the fluid pathway exit, the leading end further may include a tip region converging to a point facilitating pushing of the leading end deeper into the soil.

The diameter of the leading end upstream from the fluid pathway exit may define an obstacle obstructing upstream travel of the expandable fluid outside the fluid pathway exit.

The shaft further may include an immediate transition between the section of the leading end having a reduced diameter and the leading end upstream from the fluid pathway exit (having a larger diameter), so that the differential between the respective diameters defines an annular face outstanding around the shaft essentially perpendicular to the leading end's surface. In another embodiment, the annular face has a diameter greater than the diameter of the leading end upstream from the fluid pathway exit.

In another embodiment, the shaft further may include a gradual transition between the section of the leading end having a reduced diameter and the leading end upstream from the fluid pathway exit (having a larger diameter). In such example, there may be a differential gradient between the respective diameters, rather than an immediate transition with an essentially perpendicular gradient. Due to the diameter enlargement from the fluid pathway exit to a point upstream of that exit, the adjacent soil may be more compacted as the diameter increases, leaving less space for escape of injected expandable fluid upward along the shaft. In another embodiment, the differential gradient increases to a diameter greater than the diameter of the leading end upstream from the fluid pathway exit. In this example, there is essentially a ring or annular face outstanding around the surface of the shaft, to additionally obstruct the possible back flow of injected expandable fluid after it has left the fluid pathway exit.

The leading end of the shaft further may include a means of shielding the fluid pathway exit, to prevent clogging by soil or other debris as it is being pushed into the soil. Such shielding may include, for each such exit, an overhang portion of the shaft cantilevering over the exit. In one embodiment, at least one of the fluid pathway exits may include a notch cut diagonally downstream through the shaft wall and into the pathway, reducing the diameter of the shaft at the fluid pathway exit until the notch is terminated at the overhang portion of the leading end.

Besides the aforementioned apparatus and device, the invention disclosed herein includes a method of raising an underground footing or foundation using a means of pumping expandable fluid for injection into soil below the area of the footing or foundation to be raised, the expandable fluid expanding and hardening into expanded material during a post-injection curing duration, the method may include the steps of:

(a) pushing the shaft described in claim 1 into the soil until the fluid pathway exit is beneath the area to be raised;
(b) connecting the upstream trailing end to the means of pumping expandable fluid, and then injecting the expandable fluid into and through the device, into the soil beneath the area being treated to be raised;
(c) allowing the expandable fluid to begin expanding and solidifying;
(d) pushing the shaft further into the soil until the fluid pathway exit is in a deeper position beneath the area to be raised; and
(e) injecting more of the expandable fluid into and through the device, into the soil beneath the area to be raised.

The method further may include, prior to the pushing the shaft into the soil, drilling a bore into the soil almost to the depth desired for commencing the injecting. In such instances, the shaft might be pushed down into the soil to the first injection site while the upstream trailing end is already connected to the means of pumping expandable fluid. Preferably the bore has a diameter slightly less than that of the shaft, to provide a snug pathway to at least almost the desired depth the leading end of the shaft is to be pushed to.

The method further may include, before allowing the expanding fluid to solidify, blowing air rather than injecting expandable fluid through and out of the shaft and fluid pathway exit. This will lessen the likelihood the expandable fluid will solidify within the fluid pathway within the shaft, and facilitate re-use of the shaft. The method further may include, after the blowing air, waiting a duration before pushing the shaft further into the soil and injecting more expanding fluid into and through the device and into the soil; the duration may include a length of time sufficient to allow the injected fluid to substantially solidify. The blown air may be chilled air. This will cool the fluid pathway through the injection rod, which will inhibit the expansion of foam back up into the injection rod. The chill likely also accelerates hardening or curing of the foam at that interface.

The method further may include the step of removing the shaft from the soil, for re-use.

The method further including repetition of step (d) and step (e) above any number of times needed to complete raising the area to be raised. The method further may include, for any repetition of step (d) and step (e), performing an additional step of blowing air rather than expandable fluid into and through the device and into the respective area treated before the allowing the injected fluid to solidify.

The injecting comprises injecting a predetermined amount of expandable fluid having a predetermined expansion coefficient and predetermined expansion time, then awaiting the expansion time to determine whether further pumping is warranted.

The method further may include, before pushing the shaft further into the soil and injecting more expanding fluid, rotating the shaft less than 360 degrees while injecting additional expanding fluid in an amount sufficient to provide additional containment of expanded material to obstruct escape of subsequently injected expandable fluid above the directional fluid pathway exit. One key to the method disclosed herein is to maintain containment of the injected expanding fluid within the injection site, rather than having it expand upwardly along the shaft. With the fluid pathway exit on the side of the shaft rather than at its tip, injection of the expandable fluid occurs in a directional manner. Axial rotation of the shaft re-directs that injection flow. When injected slowly at an injection site (especially the first injection site), in amounts insufficient to result in back flow up the outer wall of the shaft, one or more additional injections following shaft rotation will result in good containment of the injected expandable fluid. That containment also benefits subsequent injections at deeper injection sites, after the shaft has been pushed through the initial injection site and deeper into the soil beneath the area to be raised.

While a preferred embodiment of the present invention has been described, it should be understood that various changes, adaptations and modifications may be made therein without departing from the spirit of the invention. Changes may be made in details, particularly in matters of shape, size, material, and arrangement of parts without exceeding the scope of the invention.

While the forms of device herein described constitute preferred embodiments of the invention, it is to be understood that the invention is not limited to these precise forms of the device, and that changes may be made therein without departing from the scope and spirit of the invention as defined in the appended claims.

Those skilled in the art will recognize improvements and modification to the preferred embodiments of the present disclosure. All such improvements and modifications are considered within the scope of the concepts disclosed herein and the claims that follow.

I claim:

1. A device for raising an underground footing or foundation by pumping expandable fluid for injection into soil below the area of the footing or foundation to be raised, the device comprising an elongated shaft comprising a trailing end and a leading end and defining a fluid pathway from the upstream trailing end to the downstream leading end, said trailing end adapted to secure fluid communication between said fluid pathway and the pump, said leading end comprising a leading tip portion including a fluid pathway exit on a lateral surface of said leading tip portion immediately upstream of a converging tip, said leading end further comprising an intermediate portion upstream of said fluid pathway exit and having a larger diameter than said leading tip portion upstream of said tip, said larger diameter defining an obstacle obstructing upstream travel of the expandable fluid outside said fluid pathway exit.

2. The device described in claim 1 above, further comprising an immediate transition between said section of said leading end having a reduced diameter and said leading end upstream from said fluid pathway exit, so that a differential between the respective diameters defines an annular face around said shaft essentially perpendicular to said leading end's surface.

3. The device described in claim 2 above, wherein said annular face has a diameter greater than said diameter of said leading end upstream from said fluid pathway exit.

4. The device described in claim 1 above, further comprising a gradual transition between said section of said leading end having a reduced diameter and said leading end upstream from said fluid pathway exit, defining a differential gradient between the respective diameters.

5. The device described in claim 4 above, wherein said differential gradient increases to a diameter greater than said diameter of said leading end upstream from said fluid pathway exit.

6. The device described in claim 1 above, further comprising an overhang portion of said shaft cantilevering over said exit.

7. A device described in claim 6 above, at least one of said fluid pathway exits comprising a notch cut diagonally downstream through said shaft and into said pathway, reducing the thickness of the shaft until terminating at said overhang portion of the leading end.

* * * * *